US006845922B2

(12) United States Patent
Stark

(10) Patent No.: US 6,845,922 B2
(45) Date of Patent: Jan. 25, 2005

(54) CHILD RESISTANT INDEXING NOZZLE FOR A TRIGGER SPRAYER

(75) Inventor: Jeffrey P. Stark, Wentzville, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/458,434

(22) Filed: Jun. 10, 2003

(65) Prior Publication Data

US 2004/0251316 A1 Dec. 16, 2004

(51) Int. Cl.[7] ..... A62C 13/62

(52) U.S. Cl. ..... 239/302; 239/333; 222/153.13; 222/153.14; 222/381.1

(58) Field of Search ..... 239/302, 229, 239/331, 333, 367; 222/153.13, 153.14, 381.1

(56) References Cited

U.S. PATENT DOCUMENTS

| | | | | | |
|---|---|---|---|---|---|
| 4,204,614 | A | * | 5/1980 | Reeve | 222/153.14 |
| 4,257,561 | A | | 3/1981 | McKinney | |
| 5,040,702 | A | * | 8/1991 | Knickerbocker et al. | 222/153.07 |
| 5,050,779 | A | | 9/1991 | Knickerbocker | |
| 5,161,716 | A | | 11/1992 | Knickerbocker | |
| 5,228,600 | A | | 7/1993 | Steijns et al. | |
| 5,238,152 | A | * | 8/1993 | Maas et al. | 222/153.09 |
| 5,297,701 | A | * | 3/1994 | Steijns et al. | 222/153.05 |
| 5,482,186 | A | * | 1/1996 | Rodden, Jr. | 222/153.07 |
| 5,823,395 | A | * | 10/1998 | Foster et al. | 222/153.02 |
| 5,823,396 | A | * | 10/1998 | Vollmerhaus et al. | 222/153.13 |
| 6,003,738 | A | * | 12/1999 | Foster et al. | 222/384 |
| 6,158,624 | A | * | 12/2000 | Grigg et al. | 222/145.6 |
| 6,186,366 | B1 | * | 2/2001 | Good et al. | 222/153.14 |
| 6,543,649 | B1 | * | 4/2003 | Danielo et al. | 222/153.13 |
| 6,543,650 | B1 | * | 4/2003 | Sprick et al. | 222/153.14 |
| 6,669,058 | B1 | * | 12/2003 | Sweeton | 222/153.13 |

FOREIGN PATENT DOCUMENTS

| | | | |
|---|---|---|---|
| EP | 1277518 A2 | * | 1/2003 |
| GB | 2041339 A | * | 9/1980 |
| JP | 410146545 A | * | 6/1998 |
| WO | WO99/33576 | * | 7/1999 |

* cited by examiner

*Primary Examiner*—William E. Tapolcal
*Assistant Examiner*—Mohammad M. Ali
(74) *Attorney, Agent, or Firm*—Thompson Coburn, LLP

(57) ABSTRACT

An indexing nozzle assembly for a trigger sprayer has a manually rotatable cap mounted for rotation on a base of the nozzle assembly. Rotation of the cap relative to the base changes the nozzle assembly between an off condition where the nozzle assembly prevents liquid discharge from the trigger sprayer, and a combination of a spray condition, a stream condition, and/or a foam condition. The indexing nozzle assembly is provided with a child resistant feature in the form of a lock mechanism that prevents rotation of the nozzle cap relative to the nozzle base from the cap off condition position. The lock mechanism can be manually manipulated with one hand to disengage the lock mechanism, thereby permitting rotation of the nozzle cap from its off condition position relative to the base.

20 Claims, 3 Drawing Sheets

CHILD RESISTANT INDEXING NOZZLE FOR A TRIGGER SPRAYER (1) Field of the Invention The present invention pertains to a hand-held and hand-operated liquid sprayer typically called a trigger sprayer. In particular, the present invention pertains to an indexing nozzle assembly for a trigger sprayer that has a manually rotatable cap mounted for rotation on a base of the nozzle assembly. Rotation of the cap relative to the base changes the nozzle assembly between an off condition where the nozzle assembly prevents liquid discharge from the trigger sprayer, and a combination of a spray condition where the nozzle assembly dispenses liquid in a spray pattern on operation of the trigger sprayer, a stream condition where the nozzle assembly dispenses liquid in a stream pattern on operation of the trigger sprayer, and/or a foam condition where the nozzle assembly dispenses the liquid as a foam on operation of the trigger sprayer. The indexing nozzle assembly is unique in that it is provided with a child resistant feature in the form of a lock mechanism. The lock mechanism prevents rotation of the nozzle cap relative to the nozzle base with the cap in its off condition position relative to the base. The lock mechanism can be manually manipulated with one hand to disengage the lock mechanism, thereby permitting rotation of the nozzle cap with another hand from its off condition position relative to the base.

(2) Description of the Related Art

Hand-held and hand-operated liquid sprayers commonly known as trigger sprayers are well known in the liquid sprayer art. Trigger sprayers are commonly used to dispense household cleaning or cooking liquids in a stream patter, a spray pattern, or as a foam. A trigger sprayer is typically connected to a plastic bottle containing the liquid dispensed by the trigger sprayer.

A typical trigger sprayer is comprised of a sprayer housing that is connected to a neck of the liquid containing bottle by either a threaded connection or a bayonet-type connection. The sprayer housing is formed with a pump chamber, a vent chamber, a liquid discharge passage that extends from the pump chamber through the sprayer housing to a discharge orifice of the trigger sprayer, and a liquid supply passage that extends from the pump chamber through the sprayer housing to a dip tube attached to the sprayer housing. The dip tube extends into the liquid of the bottle when the trigger sprayer housing is attached to the bottle neck.

A pump piston is mounted in the pump chamber for reciprocating movement of the piston between charge and discharge positions relative to the pump chamber. A vent piston is often connected to the pump piston and is mounted in a vent chamber for reciprocating movement between a closed venting position and an opened venting position of the vent piston relative to the vent chamber. A spring is provided in the pump chamber to bias the pump piston toward its charge position and, in turn, bias the vent piston toward its vent closed position.

A trigger is mounted on the sprayer housing by a pivoting connection that enables the trigger to be manually pivoted relative to the sprayer housing. The trigger is also connected to the pump piston and vent piston. Repeating the sequence of manually squeezing the trigger toward the sprayer housing against the bias of the pump chamber spring, and then releasing the trigger oscillates the trigger about its pivot connection and reciprocates the pump piston and the vent piston in the respective pump chamber and vent chamber.

Many trigger sprayer constructions are provided with pairs of check valves or one-way valves that control the flow of liquid through the sprayer housing. One of the check valves is positioned along the liquid supply passage extending from the dip tube to the pump chamber. This valve controls the flow of liquid from the dip tube and through the supply passage to the pump chamber, and prevents the reverse flow of liquid from the pump chamber to the dip tube. The second check valve is positioned in the liquid discharge passage extending from the pump chamber to the sprayer housing discharge orifice. This valve controls the flow of liquid from the pump chamber to the liquid discharge orifice, and prevents the reverse flow of liquid from the liquid discharge orifice back to the pump chamber.

A nozzle assembly is assembled to the sprayer housing at an outlet of the liquid discharge passage. The nozzle assembly usually includes a base that is assembled to the sprayer housing at the discharge passage outlet, and a cap that is mounted for rotation on the base. The base typically has a liquid swirl chamber and the cap contains the liquid discharge orifice of the nozzle assembly. In trigger sprayers having selectable discharge conditions for the liquid discharged by the trigger sprayer, the cap is rotateable between an off position where liquid discharge from the trigger sprayer is prevented, and a combination of a spray position where the liquid discharge is in a spray pattern, a stream position where the liquid discharge is in a stream pattern, and/or a foam position where the discharge of liquid is converted to a foam. Depending on the type of trigger sprayer, the nozzle assembly could be moveable between any combination of the off, spray, stream and foam positions. However, most trigger sprayers have a nozzle assembly where the nozzle cap is positioned in an off position to prevent the unintended discharge of liquid from the trigger sprayer.

Manually oscillating the trigger on the sprayer housing reciprocates the pump piston in the pump chamber which causes liquid to be drawn from the bottle through the dip tube past the first check valve to the pump chamber. The liquid is then pumped from the pump chamber through the liquid discharge passage and past the second check valve to the liquid spinner and the liquid discharge orifice of the nozzle assembly. By rotating the nozzle assembly cap relative to the base, the trigger sprayer can be changed between the off condition where liquid discharge is prevented, to a spray condition where the liquid discharge is as a spray, to a stream condition where the liquid discharge is as a stream, and/or to a foam condition where the discharge is as a foam.

In the typical trigger sprayer described above, the nozzle assembly cap can be easily rotated away from its off position relative to the sprayer housing. With the nozzle cap moved from the off position, the liquid contents of the bottle attached to the trigger sprayer can be dispensed by manually manipulating the trigger on the sprayer housing. However, movement of the nozzle cap away from the off position also creates a condition where leakage of the liquid from the bottle through the trigger sprayer can occur if the trigger sprayer and bottle are positioned on their sides or inverted. This creates a dangerous situation should a child get hold of and invert the trigger sprayer and bottle where the leaked liquid contents of the bottle could be ingested by the child.

SUMMARY OF THE INVENTION

The indexing sprayer nozzle assembly of the present invention overcomes disadvantages associated with prior art indexing sprayer nozzle assemblies by providing a child resistant feature on the nozzle assembly. The child resistant feature prevents the nozzle cap from being rotated relative to the nozzle base away from its closed position without first disengaging the child resistant feature. One hand of the user is needed to disengage the child resistant feature while the other hand of the user rotates the nozzle cap away from its closed position, thus making it difficult for a child to move the nozzle cap from its closed position.

The child resistant indexing nozzle assembly of the present invention can be used on a variety of different types of trigger sprayers. As an illustrative example, the indexing nozzle assembly of the invention is employed on a trigger sprayer housing that is similar to sprayer housings of the prior art in that it comprises a pump chamber, a vent chamber, a liquid discharge passage and a liquid supply passage. A dip tube communicates the liquid supply passage with the interior of a bottle containing the liquid to be dispensed by the trigger sprayer.

The indexing nozzle assembly of the invention is mounted to the trigger sprayer at the outlet end of the sprayer housing discharge passage. The nozzle assembly is basically comprised of a nozzle base, a nozzle cap, and a lock mechanism. The nozzle cap is mounted to the nozzle base for rotation of the cap on the base. The lock mechanism is mounted to the nozzle base for reciprocating linear movement. The nozzle base can be a separate component part assembled to the sprayer housing, or could be an integral part of the sprayer housing.

The nozzle base has a liquid passage that extends through the base and communicates with the liquid discharge passage of the sprayer housing. A liquid spinner having a swirl chamber is positioned in the liquid passage. Radial channels communicate the swirl chamber with the base liquid passage. The configurations of the liquid spinner, the radial channels, and the swirl chamber are dependent on whether the nozzle assembly is designed to dispense liquid in a spray, stream, and/or foam pattern, in addition to being closed to prevent liquid discharge from the nozzle assembly. A slot or recessed cavity is provided in the exterior surface of the nozzle base adjacent the connection of the nozzle base to the nozzle cap.

The nozzle cap is mounted to the nozzle base for rotation of the cap about the liquid spinner of the base. The nozzle cap has an end wall that extends across the swirl chamber of the liquid spinner. A liquid discharge orifice passes through the end wall. An inner cylindrical section of the nozzle cap projects from an interior surface of the cap end wall and engages in a sliding, sealing engagement around the liquid spinner of the base. The interior surface of the cap inner cylindrical section has a plurality of grooves, with the configurations of the grooves being dependent on whether the nozzle assembly is constructed to discharge liquid in a spray, stream, and/or foam pattern. By rotating the nozzle cap on the nozzle base, the grooves of the cap inner cylindrical section align with the channels of the base liquid spinner to determine the pattern of liquid discharged from the nozzle assembly through the discharge orifice. The cap grooves do not align with the spinner channels when the cap is moved to the off position relative to the base. The nozzle cap has at least one sidewall that surrounds the end wall and the nozzle base liquid spinner. A notch is provided in an edge of the sidewall. The notch aligns with the slot recessed into the exterior surface of the nozzle base when the nozzle cap is in its off position.

The lock mechanism has a block that is mounted in the nozzle base slot for sliding movement of the block through the base. A spring is also positioned in the nozzle base slot adjacent the block. The spring urges the block toward the nozzle cap. A lock tab is positioned on the block to engage in the notch on the nozzle cap when the cap is in the off position relative to the base. The engagement of the lock tab in the notch prevents the nozzle cap from being rotated relative to the nozzle base away from the off position of the nozzle cap. A finger pad is provided on the lock mechanism. The finger pad is engaged by a finger of a user of the trigger sprayer and is manually moved away from the nozzle cap, thereby compressing the spring in the nozzle base slot. This moves the lock tab of the lock mechanism out of the notch of the nozzle cap, thereby enabling rotation of the nozzle cap away from its off position relative to the nozzle base.

Thus, the nozzle assembly of the present invention provides a child resistant feature that requires the use of two hands to move the nozzle cap away from the off position of the cap relative to the nozzle base. The lock mechanism must first be moved by one hand of the user before the nozzle cap can be rotated by the other hand of the user. The required two-hand operation of the indexing nozzle assembly is difficult for a child to operate, preventing a child from rotating the nozzle cap away from the off position.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 1:
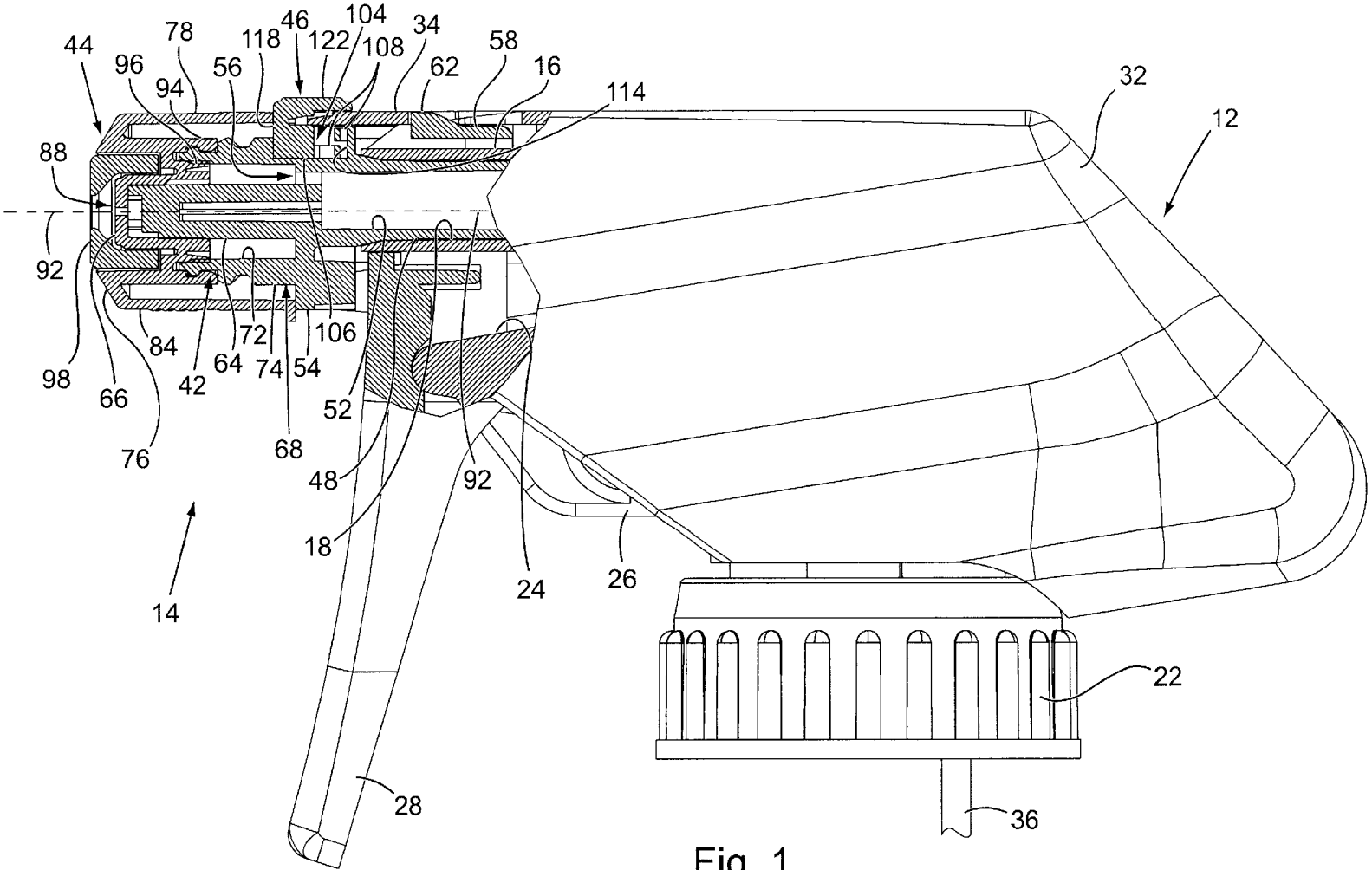
FIG. 1 is a partially sectioned side view of a trigger sprayer employing the novel child resistant indexing nozzle assembly of the invention.

The trigger sprayer 12 of the present invention is provided with an indexing nozzle assembly 14 having a novel child resistant feature that can be employed on various different types of trigger sprayers and on various different types of indexing nozzle assemblies. The indexing nozzle assembly to be described is of a type disclosed in U.S. Pat. No. 6,557,783, which issued on May 6, 2003 and is incorporated herein by reference. The nozzle assembly changes the condition of liquid discharge from the trigger sprayer between a closed condition, a foam condition, a spray condition, a second foam condition, and then is changed back into the off condition. However, it should be understood that the trigger sprayer 12 and indexing nozzle assembly 14 shown in FIG. 1 are only one example of a trigger sprayer and indexing nozzle assembly with which the child resistant feature of the invention may be used. The unique features of the indexing nozzle assembly 14, and in particular the child resistant feature, can be incorporated into a variety of different types of hand-held and hand-operated trigger sprayers having a variety of different types of indexing nozzle assemblies. For example, the child resistant feature could be used with an indexing nozzle assembly that is changed between an off condition, a spray condition, a stream condition and a foam condition.

Because the operation of the indexing nozzle assembly 14 can provide a variety of different liquid discharge conditions and does not require any particular trigger sprayer construction, the trigger sprayer 12 and indexing nozzle assembly 14 of FIG. 1 are described only generally herein.

The trigger sprayer 12 of FIG. 1 is similar to other prior art sprayers and is basically comprised of a sprayer housing 16 that contains a pump chamber (not shown), a vent chamber (not shown), a liquid supply passage (not shown) and a liquid discharge passage 18. A connector cap 22 is attached to the sprayer housing 16. The connector cap 22 can be a separate component part mounted on the sprayer housing 16, or could be an integral part of the sprayer housing. The connector cap 22 is provided with internal screw threading or an internal bayonet type fitting or other equivalent connector designed to removably attach the sprayer housing 16 to the neck of a separate liquid containing bottle (not shown).

As in conventional trigger sprayers, a pump piston (not shown) having a pump piston rod 24 is mounted in the pump chamber of the trigger sprayer housing for reciprocating movements of the piston in the pump chamber. A vent piston (not shown) having a vent piston rod 26 is mounted in the vent chamber of the sprayer housing for reciprocating movement of the vent piston in the vent chamber. The vent piston rod 26 is connected to the pump piston rod 24. Thus, when the pump piston is reciprocated in the pump chamber, the vent piston is also reciprocated in the vent chamber. A coil spring (not shown) is typically positioned in the pump chamber and engages against the pump piston to bias the piston out of the pump chamber. Thus, the spring also biases the vent piston out of the vent chamber.

A manually manipulated trigger 28 is mounted on the sprayer housing 16 for pivoting movement of the trigger relative to the sprayer housing. The trigger 28 is also connected to the pump piston rod 24 and the vent piston rod 26. Thus, manually manipulated pivoting movement of the trigger 28 reciprocates the pump piston and the vent piston in their respective pump chamber and vent chamber.

A shroud 32 is attached over the exterior of the sprayer housing 16. The typical shroud 32 covers over the top, opposite sides and rear of the sprayer housing 16 giving the trigger sprayer 12 an aesthetically pleasing appearance. The front of the shroud 32 is left open where the indexing nozzle assembly 14 and the trigger 28 project outwardly from beneath the shroud. As seen in FIG. 1, a forward edge portion 34 of the shroud is positioned adjacent the indexing nozzle assembly 14.

A dip tube 36 projects downwardly from the sprayer housing 16. The dip tube extends into the liquid contained in the bottle to which the trigger sprayer 12 is attached. The dip tube 36 communicates the liquid supply passage of the sprayer housing 16 with the liquid contained in the bottle. On manual manipulation of the trigger 28, liquid is drawn from the bottle through the dip tube 36 and to the pump chamber of the sprayer housing 16. The liquid is then pumped from the pump chamber through the liquid discharge passage 18 prior to it being discharged from the trigger sprayer through the indexing nozzle assembly 14.

The indexing nozzle assembly 14 of the present invention is basically comprised of a nozzle base 42, a nozzle cap 44 and a lock mechanism 46. Using only these three component parts of the indexing nozzle assembly 14, the assembly not only provides the ability to change the discharge condition of liquid dispensed from the nozzle assembly, but also provides a child resistant feature to the nozzle assembly. In FIG. 1 the nozzle base 42 is shown as a separate component part from the sprayer housing 16. Alternatively, the nozzle base 42 could be provided as an integral part with the sprayer housing 16, thus further reducing the total number of component parts of the trigger sprayer 12.

The nozzle base 42 is constructed with an inlet tube 48 at an upstream end of the base. The inlet tube 48 has an exterior surface that is dimensioned to be received in a tight friction fit in the inlet opening of the liquid discharge passage 18 of the sprayer housing 16. The inlet tube 48 has a cylindrical interior surface 52 that surrounds a liquid passage that extends through the nozzle base 42. The nozzle base liquid passage communicates with the liquid discharge passage 18 of the sprayer housing 16. The opposite, upstream end of the inlet tube 48 merges into a center wall 54 of the base. At least one port 56 passes through the center wall and communicates with the nozzle base liquid passage defined by the inlet tube interior surface 52.

An attachment flange 58 projects outwardly from the nozzle base center wall 54 on the same side of the wall as the inlet tube 48. The attachment flange 58 is spaced radially outwardly from the exterior surface of the inlet tube 48. The attachment flange 58 has a projection 62 that is employed in assembling the nozzle base 42 to the trigger sprayer 12. As seen in FIG. 1, the projection 62 engages in an opening in the trigger sprayer shroud 32 and engages against the forward edge portion 34 of the shroud. This engagement holds the nozzle base 42 and the shroud 32 in their relative positions on the trigger sprayer housing 16.

A liquid spinner shaft 64 projects in the downstream direction from the opposite side of the nozzle base center wall 54 from the inlet tube 48. The spinner shaft 64 is constructed in the conventional manner of indexing nozzle assemblies such as that described in the earlier reference U.S. Pat. No. 6,557,783. It should be understood that the construction of the spinner shaft 64, and in particular the construction of the spinner head and swirl chamber at the distal end 66 of the spinner shaft will change depending on the desired liquid discharge conditions of the indexing nozzle assembly.

A cylindrical wall 68 projects in the downstream direction from the nozzle base center wall 54. The cylindrical wall 68 has a cylindrical interior surface 72 that extends around and is radially spaced from the spinner shaft 64. The radial spacing between the cylindrical wall interior surface 72 and the spinner shaft 64 forms a portion of the liquid passage extending through the nozzle base 42. The cylindrical wall 68 has an opposite exterior surface 74 that is configured to support the nozzle cap 44 for rotation of the cap on the nozzle base 42. The configuration of the exterior surface 74 of the cylindrical wall 68 will again depend on the desired liquid discharge conditions of the indexing nozzle assembly 14. For example, the exterior surface 74 of the nozzle base cylindrical wall 68 shown in FIG. 1 enables the indexing nozzle assembly 18 to function in the manner described in the earlier referenced patent. This indexing nozzle assembly 14 provides a closed condition, a foam condition, a spray condition, a second foam condition, and again the off condition by rotating the nozzle cap 44 one complete revolution on the nozzle base 42.

The nozzle cap 44 has an exterior configuration with a general cube shape defined by a front-end wall 76, and four cap sidewalls 78, 82, 84, 86. The four cap side walls 78, 82, 84, 86 have indicia that indicate the different conditions of the nozzle assembly when the cap is rotated to different positions on the base. One of the cap sidewalls 78 is provided with an "off" indicia. Another of the cap sidewalls 82 is provided with a "foam" indicia, another of the cap sidewalls 84 is provided with a "spray" indicia, and the fourth of the cap sidewalls 86 is provided with a second "foam" indicia. The nozzle cap end wall 76 has a cylindrical discharge orifice 88 that passes through the end wall. The orifice 88 has a center axis 92 that defines an axis of rotation of the nozzle cap 44 on the nozzle base 42. The orifice 88 communicates the exterior environment of the trigger sprayer with the swirl chamber in the spinner shaft distal end 66, the nozzle base liquid passage defined by the inlet tube interior surface 52, and the liquid discharge passage 18 passing through the sprayer housing 16.

The interior of the nozzle cap 44 has a coupling cylinder 94 that engages over the exterior surface 74 of the nozzle base cylindrical wall 68 in coupling the nozzle cap 44 for rotation on the nozzle base 42. The nozzle cap interior also has a sealing cylinder 96 that engages in sliding, sealing contact against the interior surface 72 of the nozzle base cylindrical wall 68.

A foaming tube 98 is mounted to the nozzle cap 44 for axial movement of the foaming tube relative to the nozzle cap in response to rotation of the nozzle cap on the nozzle base 42. Operation of the foaming tube 98 and the function it performs are described in the earlier referenced U.S. Patent.

Figure 2:
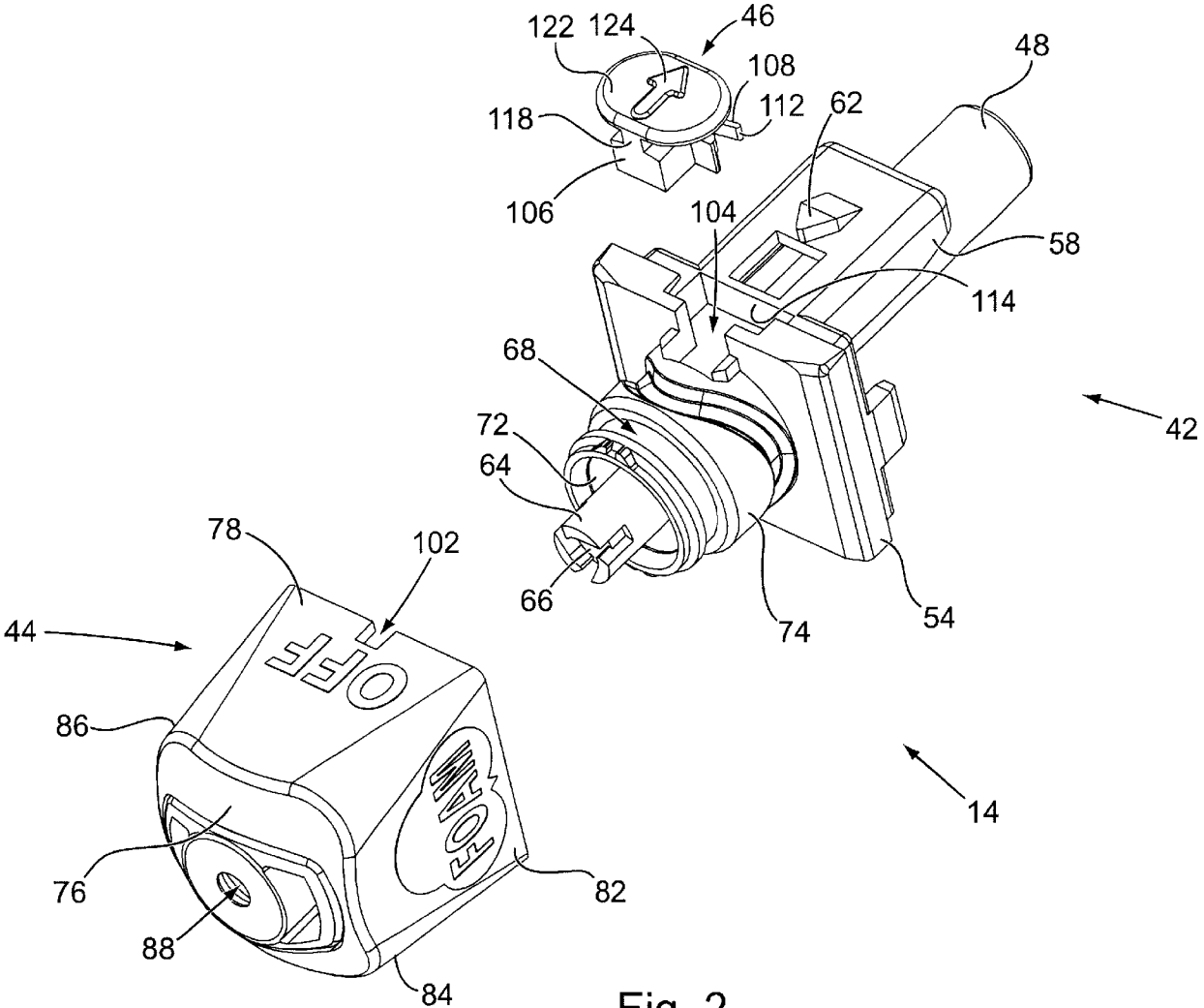
FIG. 2 is a front perspective view of the disassembled component parts of the indexing nozzle assembly of the invention, which has been disassembled from the trigger sprayer of FIG. 1; and, FIG. 3 is a rear perspective view of the component parts of the indexing nozzle assembly.

As stated earlier, the indexing nozzle assembly 14 of the trigger sprayer 12 differs from that of prior art indexing nozzle assemblies in that it is provided with a child resistant feature. The child resistant feature includes a notch 102 formed in an edge of one of the nozzle cap sidewalls 78 as shown in FIG. 2. The notch 102 is formed in the edge of the sidewall 78 with the "off" indicia. This sidewall 78 is positioned at the top of the nozzle cap 44 when the nozzle cap is moved in position for its off condition as shown in FIG. 1. In this position of the nozzle cap 44, the cap prevents the flow of liquid through the sprayer housing discharge passage 18, the nozzle base liquid passage defined by the interior surface 72 of the base cylindrical wall 68, and the nozzle cap liquid discharge orifice 88. In order to discharge liquid through the indexing nozzle assembly 14, the nozzle cap 44 must be rotated so that the "off" nozzle cap side wall 78 is moved from its position at the top of the trigger sprayer 12 shown in FIG. 1.

The child resistant feature of the invention includes a slot 104 recessed into the top of the nozzle base 44 as shown in FIG. 2. As seen in FIG. 2, the slot 104 is formed by a cavity recessed into portions of the nozzle base attachment flange 58, the nozzle base center wall 54 and the nozzle base cylindrical wall 68. Thus, the length of the notch extends in the downstream direction or along the rotation axis 92 of the nozzle cap. The length of the slot 104 positions a forward portion of the slot beneath the nozzle cap notch 102 with the nozzle cap moved to it's off condition position shown in FIG. 1.

The child resistant feature also includes the lock mechanism 46 that has a sliding block 106 that is received in the slot 104 in the nozzle base 42. The sliding block 106 has a length dimension that is shorter than the length dimension of the nozzle base slot 46, enabling the block 106 to slide axially along the length of the slot 104. The block 106 has a width dimension that is slightly smaller than the width dimension of the slot 104, which maintains the orientation of the block 106 in the slot 104. As shown in FIG. 1, the shroud forward edge portion 34 extends over the sliding block 106 and holds the sliding block 106 in the slot 104 of the nozzle base 42.

Figure 3:
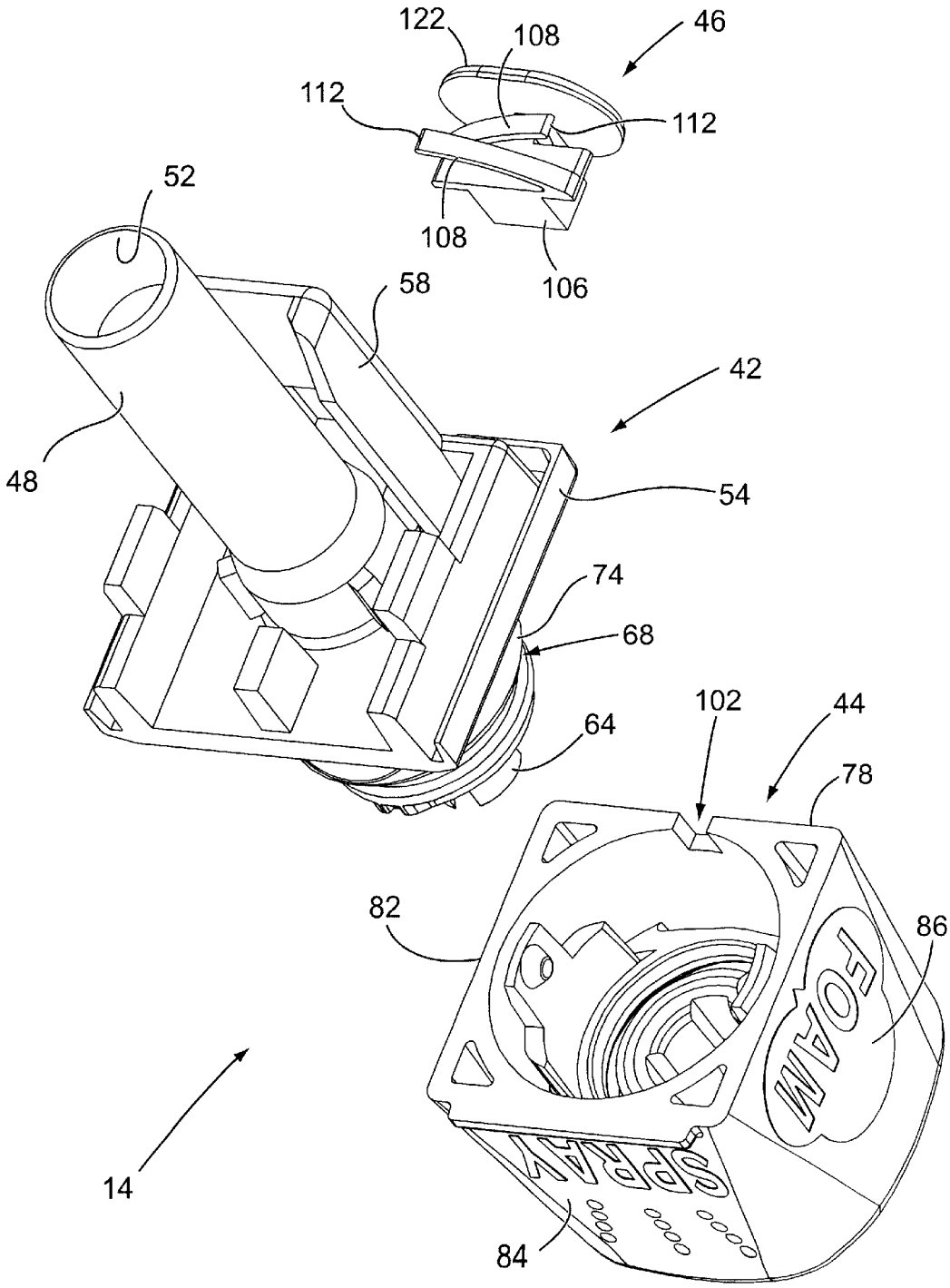

A spring is formed integrally with the sliding block 106 to bias the block through the nozzle base slot 104 toward the nozzle cap 44. The spring is formed by a pair of resilient leaf springs 108 that project outwardly at angles from opposite sides of the sliding block 106. As best seen in FIG. 3, the lengths of the leaf springs 108 crisscross as the leaf springs extend to their distal ends 112. The distal ends 112 of the leaf springs 108 engage against the upstream end 114 of the nozzle base slot 104 and urge the block 106 through the slot in the downstream direction. The shroud forward edge portion 34 also extends over the leaf springs 108 and holds the leaf springs in the nozzle base slot 104.

The sliding block 106 has a lock tab 118 that projects upwardly from the top of the block. The lock tab 118 is dimensioned to be received in the nozzle cap notch 102 when the leaf springs 108 push the block to its forward most position in the nozzle base slot 104 with the nozzle cap 44 positioned in its off position. Engagement of the lock tab 118 in the nozzle cap notch 102 prevents the nozzle cap 44 from being rotated relative to the nozzle base 42 out of is off condition position. A finger pad 122 is provided at the top of the lock tab 118 for easy access by a user of the trigger sprayer 12. An arrow indicia 124 on the top of the finger pad 122 points in the direction in which the finger pad must be moved to disengage the child resistant feature of the nozzle assembly.

To disengage the child resistant feature of the indexing nozzle assembly 14, the user of the trigger sprayer 12 must first engage the finger pad 122 with the finger of one hand and move the finger pad in the direction indicated by the arrow 124. This causes the sliding block 106 to slide through the nozzle base slot 104 in the upstream direction, compressing the leaf springs 108 in the nozzle base slot 104. This movement also disengages the lock tab 118 from the notch 102 in the nozzle cap sidewall 78. With the lock tab 118 disengaged from the nozzle cap notch 102, the user of the trigger sprayer can now rotate the nozzle cap 44 away from its off condition position shown in FIG. 1 to any of the other positions of the nozzle cap relative to the nozzle base 44 where the cap permits the discharge of liquid through the indexing nozzle assembly 14. When use of the trigger sprayer 12 is complete, the user then rotates the nozzle cap 44 to its off condition position with the side wall 78 having the "off" indicia positioned at the top of the indexing nozzle assembly 14. This will align the nozzle cap notch 102 with the lock tab 118 of the lock mechanism 46. The leaf springs 108 will then move the sliding block 106 in a downstream direction through the nozzle base slot 104 causing the lock tab 118 to enter into the nozzle cap notch 102. This again locks the nozzle cap 44 to the nozzle base 42 preventing rotation of the cap relative to the base.

Thus, the indexing nozzle assembly 14 of the invention provides a lock mechanism 46 that must be disengaged by using two hands, thereby providing a child resistant feature to the indexing nozzle assembly 14 of the invention.

Although a particular embodiment of the trigger sprayer and the indexing nozzle assembly have been described above, it should be understood that other modifications and variations could be made to the trigger sprayer and indexing nozzle assembly without departing from the scope of the invention defined in the following claims.

What is claimed is:

1. A trigger sprayer comprising:

a nozzle base having a liquid passage extending through the nozzle base;

a nozzle cap mounted on the nozzle base for rotation of the nozzle cap around an axis of rotation relative to the nozzle base; and, a lock mechanism mounted on the nozzle base for axially reciprocating movement between first and second positions of the lock mechanism relative to the nozzle base, where in the first position the lock mechanism prevents rotation of the nozzle cap relative to the nozzle base and in the second position the lock mechanism permits rotation of the nozzle cap relative to the nozzle base.

2. The trigger sprayer of claim 1, further comprising:

a spring biasing the lock mechanism toward the first position.

3. The trigger sprayer of claim 2, further comprising:

the spring being an integral part of the lock mechanism.

4. The trigger sprayer of claim 2, further comprising:

the spring being positioned between the lock mechanism and the nozzle base.

5. The trigger sprayer of claim 2, further comprising:

the spring being a leaf spring.

6. The trigger sprayer of claim 2, further comprising:

the spring being a pair of leaf springs that crisscross each other.

7. The trigger sprayer of claim 2, further comprising:

a slot in the nozzle base; and, the lock mechanism and the spring being positioned in the slot for sliding movement of the lock mechanism in the slot between the first and second positions of the lock mechanism relative to the nozzle base.

8. The trigger sprayer of claim 7, further comprising:

a shroud on the trigger sprayer, the shroud having an edge portion that extends over the slot and holds the lock mechanism and the spring in the slot.

9. The trigger sprayer of claim 2, further comprising:

the nozzle cap having an end wall with a liquid discharge orifice passing through the end wall and communicating with the nozzle base liquid passage, the liquid discharge orifice having a center axis that is coaxial with the nozzle cap axis of rotation.

10. The trigger sprayer of claim 2, further comprising:

a sprayer housing having a liquid discharge passage extending through the sprayer housing;

a trigger mounted on the sprayer housing for pivoting movement of the trigger on the sprayer housing; and, the nozzle base being attached to the sprayer housing with the nozzle base liquid passage communicating with the sprayer housing liquid discharge passage.

11. The trigger sprayer of claim 10, further comprising:

a shroud on the sprayer housing, the shroud having a portion extending over the nozzle base and the lock mechanism that holds the lock mechanism on the nozzle base.

12. The trigger sprayer of claim 2, further comprising:

the nozzle base having a liquid spinner with a swirl chamber.

13. The trigger sprayer of claim 1, further comprising:

a notch in the nozzle cap; and, a lock tab on the lock mechanism that engages in the notch when the lock mechanism is in the first position relative to the nozzle base, the lock tab engaging in the notch preventing the nozzle cap from rotating relative to the nozzle base.

14. The trigger sprayer of claim 13, further comprising:

the nozzle cap having an end wall with a liquid discharge orifice passing through the end wall and communicating with the nozzle base liquid passage, the discharge orifice having a center axis that is coaxial with the nozzle cap axis of rotation.

15. The trigger sprayer of claim 14, further comprising:

the nozzle cap having at least one sidewall that is rotatable with the nozzle cap around the nozzle cap axis of rotation, and the notch being in the nozzle cap sidewall.

16. The trigger sprayer of claim 14, further comprising:

the nozzle cap having four sidewalls that are positioned around the end wall and are oriented at an angle relative to the end wall, and the notch is positioned in one of the four sidewalls.

17. The trigger sprayer of claim 13, further comprising:

a slot in the nozzle base; and, the lock mechanism being positioned in the slot for sliding movement of the lock mechanism in the slot between the first and second positions of the lock mechanism relative to the nozzle base.

18. The trigger sprayer of claim 17, further comprising:

a shroud on the trigger sprayer, the shroud having an edge portion that extends over the slot and holds the lock mechanism in the slot.

19. The trigger sprayer of claim 13, further comprising:

a sprayer housing with a liquid discharge passage extending through the sprayer housing;

a trigger mounted on the sprayer housing for pivoting movement of the trigger on the sprayer housing; and, the nozzle base being attached to the sprayer housing with the nozzle base liquid passage communicating with the sprayer housing liquid discharge passage.

20. The trigger sprayer of claim 19, further comprising:

a shroud on the sprayer housing covering over an exterior of the sprayer housing, the shroud having a portion that extends over the nozzle base and the lock mechanism and holds the lock mechanism on the nozzle base.

* * * * *